US011794374B2

(12) United States Patent
Vaessen et al.

(10) Patent No.: US 11,794,374 B2
(45) Date of Patent: Oct. 24, 2023

(54) MAKING PROFILE-EDGE CONSTRUCTION BOARD

(71) Applicants: Michael Vaessen, Neuss (DE); Patrick Harf, Krefeld (DE); Ulrich Maier, Duesseldorf (DE)

(72) Inventors: Michael Vaessen, Neuss (DE); Patrick Harf, Krefeld (DE); Ulrich Maier, Duesseldorf (DE)

(73) Assignee: SIEMPELKAMP MASCHINEN—UND ANLAGENBAU GMBH, Krefeld (DE)

( * ) Notice: Subject to any disclaimer, the term of this patent is extended or adjusted under 35 U.S.C. 154(b) by 0 days.

(21) Appl. No.: 17/520,692

(22) Filed: Nov. 7, 2021

(65) Prior Publication Data

US 2022/0143863 A1 May 12, 2022

(30) Foreign Application Priority Data

Nov. 9, 2020 (DE) ..... 102020006861.8

(51) Int. Cl.

| | |
|---|---|
| ***B27N 3/18*** | (2006.01) |
| ***B27N 3/02*** | (2006.01) |
| ***B27N 3/24*** | (2006.01) |
| ***B27N 7/00*** | (2006.01) |

(52) U.S. Cl.

CPC ..... *B27N 3/183* (2013.01); *B27N 3/02* (2013.01); *B27N 3/24* (2013.01); *B27N 7/005* (2013.01)

(58) Field of Classification Search

CPC . B27N 3/18; B27N 3/183; B27N 3/02; B27N 3/24; B27N 7/005; B27C 5/08

See application file for complete search history.

(56) References Cited

U.S. PATENT DOCUMENTS

| | | | | |
|---|---|---|---|---|
| 3,577,936 A * | 5/1971 | Emery | ..... | A47C 3/36 297/423.46 |
| 7,093,628 B2 * | 8/2006 | Kelly | ..... | B27C 5/08 144/41 |
| 2022/0120095 A1 * | 4/2022 | Van Vlassenrode | ..... | B29C 43/305 |

FOREIGN PATENT DOCUMENTS

| | | | | |
|---|---|---|---|---|
| CN | 109500976 A * | 3/2019 | ..... | B27N 1/0209 |
| DE | 102015107376 A | 11/2016 | | |

OTHER PUBLICATIONS

CN109500976A-Machine Translation (Year: 2019).*

* cited by examiner

*Primary Examiner* — Yunju Kim
(74) *Attorney, Agent, or Firm* — Andrew Wilford

(57) ABSTRACT

Construction board is made by first hot-pressing particles in a continuous belt press to form a longitudinally extending, continuous and hot composite strand that is conveyed downstream from the press. Before substantial cooling of the boards and while it is at a predetermined temperature above ambient temperature, an edge of the strand is profiled into a nonsquare profiled contour. Then the strand is transversely severed to form a succession of boards.

8 Claims, 2 Drawing Sheets

MAKING PROFILE-EDGE CONSTRUCTION BOARD

FIELD OF THE INVENTION

The present invention relates to the manufacture of construction board. More particularly this invention concerns making construction board with a profiled nonsquare edge.

BACKGROUND OF THE INVENTION

Construction board is typically made by pressing particles in a continuous press between two moving and heated belts that compress the particles into a flat composite strand that is cut into boards of the desired size on exiting the press and then can be finished by edge profiling to have a profiled nonsquare edge.

The invention also relates to an apparatus for making construction board and having a heated continuous belt press producing a flat composite strand or web, a cutting device for longitudinally subdividing the strand or web into construction boards of the desired size and a profiling device to form the desired nonsquare edge contour.

Construction boards are typically wood-based panels that are made as described above from a compressed-particle or sheet web and sawn to the desired size. Particle, MDF, or OSB boards are formed from wood fibers or chips and a binding agent. More recently, other lignocellulosic materials, for example the fibers of annual plants (e.g. rice straw) is used to make construction board. However, a construction board according to the invention can also be an insulation panel, gypboard, plastic paneling or other construction material whose particles are hot-pressed between belts to form the basic flat strand workpiece from which the individual boards are cut.

Such a press is marketed by applicant under the trade name ContiRoll®. The particles and binder are mixed together upstream of the continuous press, so that the construction boards are very stable. The strand produced by such a continuous press manufactured in this way is very flat and easily cut on the fly into individual boards. The thickness of such a board is typically less than a hundredth of its width or length.

The edge-profiling process is primarily a matter of contouring the edge of a construction board, normally by milling, although grinding, cutting, and other procedures are usable.

This profiling serves for example to straighten the edge of the composite strand that normally emerges from the continuous press somewhat thicker at the edges than inward therefrom and often somewhat ragged. Such profiling however often leads to problems when the board is to subsequently be coated either with a liquid or with paper or film. Also there are several edge shapes or contours, in particular with gypboard, where the edges are often beveled or rounded (see DIN EN 520).

Chipboard or MDF board is coated with for example (resin-soaked) papers, linoleum or plastic film. Often the finished construction board has profiled edges. Such boards are used for example in the furniture industry, where such edge shapes are made according to customer requirements by cutting or milling.

Nowadays, however, this is always done after the construction boards are manufactured and have largely cooled down. That means that the manufacturing process is divided into a first stage that produces the individual hot boards that are then for instance put in a large star cooler (see DE 10 2015 107 376 for cooling before the edges are profiled.

Coating the construction board with a paper or a film in a laminating or laminating device must then wait until the profile edge is created. This results in an overall very slow manufacturing process having various stages and at least one complete stop for cooling.

OBJECTS OF THE INVENTION

It is therefore an object of the present invention to provide an improved method of making edge-profiled construction boards.

Another object is the provision of such an improved method of making edge-profiled construction boards that overcomes the above-given disadvantages, in particular that operates substantially continuously and without stopping.

SUMMARY OF THE INVENTION

A method for making construction boards has according to the invention the steps of hot-pressing particles in a continuous belt press to form a longitudinally extending, continuous and hot composite strand, before substantial cooling of the boards and while same is at a predetermined temperature above ambient temperature, profiling an edge of the strand into a nonsquare profiled contour, and transversely severing the strand to form a succession of hot boards.

Thus the strand workpiece is moved continuously through a profiling station and a cutting station and the object of the invention is attained in that the profiling process takes place before the strand has cooled to ambient temperature. This saves an enormous amount of time in the manufacturing process of construction board. It was surprisingly learned that profiling on the edges, in particular the longitudinal edges, of the composite strand that is subsequently cut into construction boards, can be carried out on the hot strand before it has cooled significantly from the press temperature. This way the strand does not have to be profiled on all edges after being severed into boards. Between the downstream end of the continuous press and the profiling device one needs at most a trimming device to cut the strand to the desired board width and give it two clean longitudinal edges. In this case, the trimming device and the profiling device can be built as a single machining assembly and in fact be very close to each other in the travel direction. This way only the transversely extending end edges of the boards need by profiled.

It is advantageous if the profiling process takes place before the strand cools to a temperature midway between the temperature of the composite strand at the outlet of the continuous press and the ambient temperature. In other words, the profiling is carried out at a temperature at least equal to ambient temperature plus half the difference between the predetermined (fresh from the press) and ambient temperatures.

This significantly shortens the size of the plant for making construction board. In fact profiling the composite strand can even be done without difficulty with the strand at a temperature above the temperature of the composite strand at the outlet of the continuous press and the ambient temperature, without later undesired tensions being set in the manufactured construction boards.

It is preferred if the profiling step is carried out between the outlet of the continuous press and a saw at a location downstream therefrom in the travel path defined by the conveyor. This saw serves to subdivide the strand into a row of separate construction boards.

The individual boards formed by the saw usually are of standard size and already also have two profiled edges, without the strand workpiece having to go through the cooling process, for example in a star cooling rack before being profiled. The time saved makes for faster manufacture and/or fewer post-processing machines.

The profiling process preferably comprises a part-round milling of the side edge of the composite strand. In retrospect, part-round milling can be a lot more elaborate when carried out just downstream of the continuous press or a trimming device, and can even be ogee-like.

It is of particular advantage if between the profiling process and the subdivision of the composite strand into individual boards at least one face of the composite strand is coated. Since the strand is profiled before subdividing it into individual boards, for example by a diagonal circular saw, it can also have a coating in one simple process even before division of the composite strand into individual boards. Thus the inventive process has steps or stations for: pressing, trimming, profiling, coating, and subdividing.

It is even possible that the composite strand is coated on both faces after the profiling process and before subdivision of the composite strand into individual boards.

The coating is preferably carried out by adhering a paper sheet or synthetic-resin film to at least on face of the composite strand, in particular by gluing.

This one coated face is the upper or lower face of the flat composite strand. The coating materials (paper or film), for example, are unwound from respective supply rolls and pressed against the respective faces. Additionally the strand or coating layer can be sprayed with an adhesive. The novel order of the processing steps has the special advantage that the composite strand is still warm during the coating process, which can have a very beneficial effect on gluing.

The board-making apparatus of this invention has a profiling device that is at most 20 m downstream of the downstream outlet end of the continuous press. This dimension ensures operation according to the above-described method. It ensures that the profiling is done while the composite strand is still warm.

It is advantageous if the conveyor comprises a track extending between the exit point of the composite strand from the continuous press and the profiling device.

The longitudinal edges of the strand extending parallel to the transport direction can therefore be contoured before the strand is cut into boards. This eliminates this job without interrupting the job. Only the new end edges created by the saw subdividing the strand into boards need any work. For a further saving of time and space, a trimmer can be provided immediately upstream of the profiling device, ensuring that the contoured edge will be perfectly shaped.

It is possible according to the invention for the profiling device to be between the downstream end of the press and a saw for subdividing the composite strand into individual boards.

The profiling device can be a quarter-round miller. Also, the strand longitudinal edges, which will form the long side edges of a standard rectangle of gypboard, can both be formed with the standard inset.

And so it is advantageously possible that between the profiling device and the saw a coating device is arranged.

It is preferred if the coating device has a supply roller for each coating layer, sheet or film.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
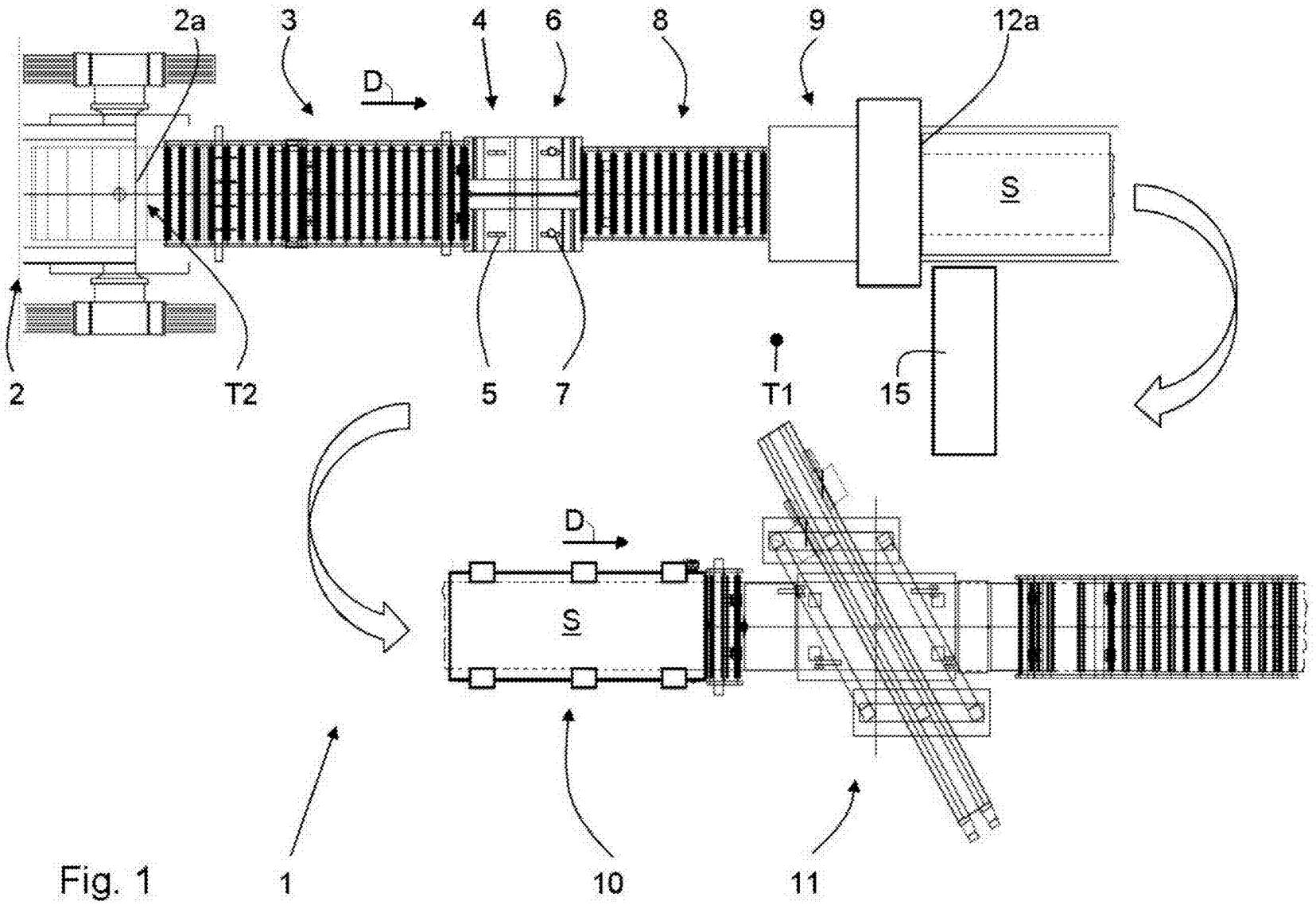
FIG. 1 is a small-scale schematic top view of a system for making construction board according to the invention, the straight transport path for the board being shown in two parallel sections.

As seen in FIG. 1 a system 1 for making a construction board has a continuous belt press 2 such as marketed by applicant under the trade name ContiRoll®. This press 2 has upper and lower heated driven belts that compress a mass formed by a mixture of particles (e.g. wood chips) and a binder into a flat longitudinally extending composite mat or strand shown in broken lines at S and moving continuously in a longitudinal and normally horizontal travel direction D. The particles are lignocellulosic fibers or wood chips, but the invention is not limited to this. The mat or strand S is compact and coherent as it leaves a downstream outlet end 2*a* of the press at a fairly high temperature T2. A roller-type conveyor 3 moves it downstream to a trimmer 4 where a pair of tools 5 true up longitudinally extending outer edges of the composite strand S. This gives the web S a rectangular cross section formed by the two planar and normally vertical and parallel longitudinal edges and the planar and normally horizontal and parallel top and bottom faces.

Figure 3:
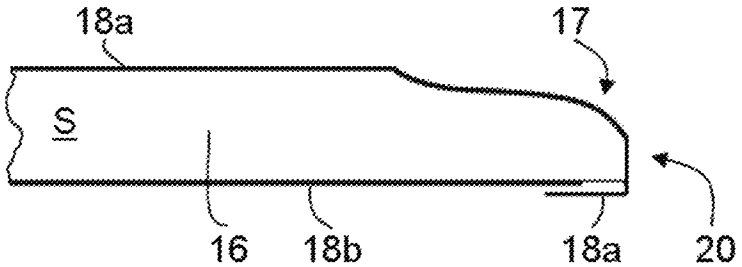
FIG. 3 is a section through an edge of a coated and profiled board.

A profiling device 6 downstream of the trimmer 4 in the direction D shapes the longitudinal outer edges of the strand to the desired nonsquare contour as shown at 17 in FIG. 3, for instance by milling with a part-round milling bit 7. This profiling takes place according to the invention while the composite strand is still at or close to the high temperature T2 that is well above ambient temperature T1. The distance between the press outlet 2*a* and the profiling device 6 is less than 20 m. During the longitudinal-edge profiling, the composite strand S is so hot that it is between the temperature T2 at the outlet 2*a* of the continuous press 2*a* and the ambient temperature T1.

Figure 2:
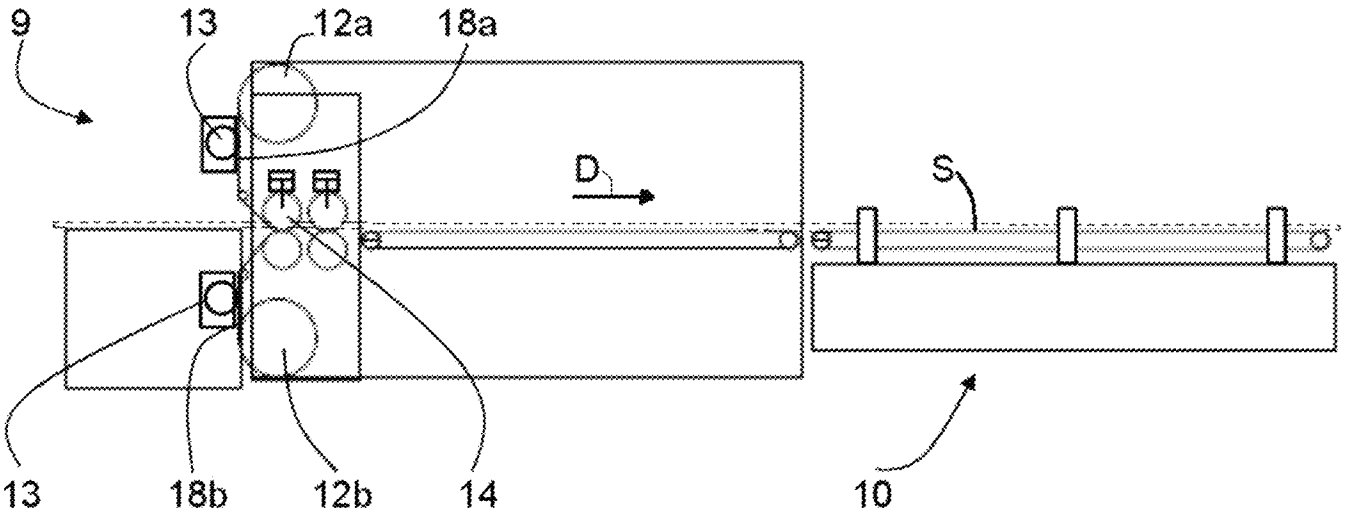
FIG. 2 is a side view of a portion of the system of FIG. 1.

The profiled composite strand is fed in a straight line from the profiling device 6 by a bridging conveyor 8 to a coating device 9. FIG. 2 shows that this coater 9 has upper and lower supply rolls 12*a* and 12*b* for respectively applying coating sheets or films 18*a* and 18*b* to the upper and lower faces of the strand S. An exchange or replacement roll 15 that also can be used on the fly is shown.

Films or resin-soaked paper may be used as the sheets 18*a* and 18*b*. FIGS. 1 and 2 show an upper paper coating 18*a* and a lower paper coating material 18*b*, each pulled through an adhesive applicator 13 so as to be coated with adhesive and finally pressed by possibly heatable rollers 14 for adhering to the upper and lower faces of the composite strand S.

This is followed by a finishing facility 10 for the coating where an edge portion 20 of a wide upper coating web 18*a* is wrapped around the profiled edge 17 and overlapped on the lower face of the strand with the lower coating layer 18*b*. This type of treatment is used on an office desk where the front edge is profiled and coated this way. According to the invention, however, this is done on the continuous strand before it is cut into individual boards.

Downstream in the direction D from the coater 9 is a diagonal saw 11 whose angle is matched to the travel speed of the workpiece to allow it to perpendicularly sever the strand S, producing boards with square leading and trailing edges that extend perpendicular to the direction D.

FIG. 3 shows a typical embodiment of a gypboard in section, showing the shape of the profiled edge 17 and the glued-on upper and lower coating sheets 18*a* and 18*b*.

Figure 4:
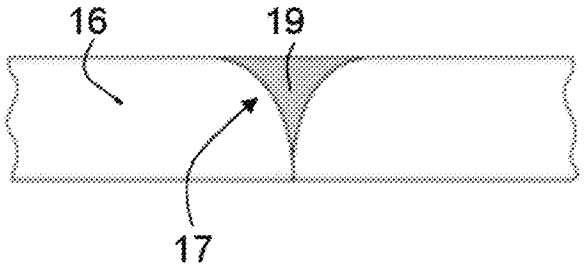
FIG. 4 is a section through the continuous strand at a location where it will be longitudinally subdivided.

The profiling must, however as shown in FIG. 4 not necessarily be made only at the edge. With a curved v-shaped cutout 19 extending transversely across the composite strand 16 one creates two sections, for example with leading and trailing transverse profiled edges that 17.

We claim:

1. A method for making construction boards, the method comprising the steps of:

hot-pressing particles in a continuous belt press to form a longitudinally extending, continuous and hot composite strand having an edge of square contour;

before substantial cooling of the boards and while same is at a predetermined temperature below a temperature at which the strand leaves the press, and above a temperature midway between the temperature at which the strand leaves the press and ambient temperature, trimming and thereby truing the edge of the strand to planarity and thereafter profiling the trimmed edge of the strand into a nonsquare profiled contour; and transversely severing the strand to form a succession of boards.

2. The board-making method according to claim 1, wherein the edge profiling is carried out downstream of an outlet of the press and upstream of a device that transversely severs the strand.

3. The board-making method according to claim 1, wherein the edge profiling entails rounding a longitudinal side edge of the strand.

4. The board-making method according to claim 1, further comprising the step after the edge profiling and before the transverse severing of:

coating at least an upper or lower face of the strand.

5. The board-making method according to claim 1, further comprising the step after the edge profiling and before the transverse severing of:

coating an upper face and a lower face of the strand.

6. The board-making method according to claim 5, wherein the coating consists of adhering a paper sheet or synthetic-resin film to at least one face of the strand.

7. The board-making method according to claim 1, wherein the transverse severing is effected by a saw after the profiling.

8. The board-making method according to claim 1, wherein the profiling is a rounding of the edge.

* * * * *